US007480949B2

(12) United States Patent
Bloomquist

(10) Patent No.: US 7,480,949 B2
(45) Date of Patent: Jan. 27, 2009

(54) STOWABLE BEARING HOLDER FOR COMBINED BARIATRIC BED AND TRANSFER SYSTEM

(75) Inventor: E. Glynn Bloomquist, Austin, TX (US)

(73) Assignee: Barton Medical Corporation, Austin, TX (US)

( * ) Notice: Subject to any disclaimer, the term of this patent is extended or adjusted under 35 U.S.C. 154(b) by 337 days.

(21) Appl. No.: 11/465,994

(22) Filed: Aug. 21, 2006

(65) Prior Publication Data

US 2007/0094790 A1 May 3, 2007

Related U.S. Application Data

(63) Continuation-in-part of application No. 11/397,317, filed on Apr. 4, 2006, now abandoned.

(60) Provisional application No. 60/709,702, filed on Aug. 19, 2005, provisional application No. 60/668,226, filed on Apr. 4, 2005.

(51) Int. Cl.
*A61G 7/057* (2006.01)

(52) U.S. Cl. ..... 5/88.1; 5/81.1 C; 5/81.1 HS

(58) Field of Classification Search ..... 5/81.1 R, 5/81.1 C, 81.1 HS, 88.1, 503.1, 658
See application file for complete search history.

(56) References Cited

U.S. PATENT DOCUMENTS

| | | | | | |
|---|---|---|---|---|---|
| 1,704,979 | A | * | 3/1929 | Kusterle et al. | 5/658 |
| 2,665,432 | A | * | 1/1954 | Butler | 5/88.1 |
| 2,783,053 | A | | 2/1957 | Sheldrick et al. | |
| 3,108,290 | A | | 10/1963 | Partridge | |
| 3,140,069 | A | | 7/1964 | McBurney et al. | |
| 3,302,219 | A | | 2/1967 | Harris | |
| 3,709,556 | A | | 1/1973 | Allard et al. | |
| 3,848,784 | A | | 11/1974 | Baxter | |
| 3,924,281 | A | * | 12/1975 | Gibbs | 5/88.1 |
| 4,068,770 | A | | 1/1978 | Boehringer | |
| 4,262,872 | A | * | 4/1981 | Kodet | 248/311.3 |
| 4,270,234 | A | | 6/1981 | James | |
| 4,747,170 | A | | 5/1988 | Knouse | |
| 4,786,064 | A | | 11/1988 | Baghdasarian | |
| 4,787,104 | A | | 11/1988 | Grantham | |
| 4,868,938 | A | | 9/1989 | Knouse | |
| 5,279,010 | A | | 1/1994 | Ferrand et al. | |
| 5,294,141 | A | | 3/1994 | Mentessi et al. | |
| 5,333,887 | A | | 8/1994 | Luther | |
| 5,340,266 | A | | 8/1994 | Hodgetts | |
| 5,697,109 | A | | 12/1997 | Hodgetts | |
| 5,819,339 | A | | 10/1998 | Hodgetts | |

(Continued)

FOREIGN PATENT DOCUMENTS

| | | |
|---|---|---|
| WO | WO 86/00221 | 1/1986 |

*Primary Examiner*—Michael Trettel
(74) *Attorney, Agent, or Firm*—The Webb Law Firm

(57) ABSTRACT

A device for use with a base of a patient support system. The device has a patient supporting member attached to the base and a sheet engaged by a roller so that the sheet may be located under a patient and moved, thereby moving the patient from one location to another. The roller is supported by a bearing member and, in accordance with the subject invention, the bearing member does not need to be removed from the base, but may be pivoted to an engaged position for engaging and supporting the roller and may be pivoted to a stowed position for storage within the base when not in use.

24 Claims, 9 Drawing Sheets

U.S. PATENT DOCUMENTS 5,996,144 A 12/1999 Hodgetts
6,282,734 B1 * 9/2001 Holberg ..... 5/81.1 HS
6,289,533 B1 9/2001 Hodgetts
6,507,963 B2 1/2003 Hodgetts
6,701,546 B2 3/2004 Hodgetts
7,062,803 B2 * 6/2006 McMahan ..... 5/53.1

* cited by examiner

STOWABLE BEARING HOLDER FOR COMBINED BARIATRIC BED AND TRANSFER SYSTEM

CROSS-REFERENCE TO RELATED APPLICATIONS

This application claims the benefit of U.S. Provisional Application No. 60/709,702, filed Aug. 19, 2005 and is a continuation-in-part of U.S. application Ser. No. 11/397,317, filed Apr. 4, 2006, now abandoned, which claims the benefit of U.S. Provisional Application No. 60/668,226, filed Apr. 4, 2005.

BACKGROUND OF THE INVENTION

1. Field of the Invention

This invention relates to a patient transport system and, more particularly, to a patient transport system for transferring an immobile patient from a bed to a gurney or from a gurney to a bed.

2. Description of the Prior Art

Patient transport systems are disclosed in U.S. Pat. Nos. 6,507,963 and 6,701,546, both of which are hereby incorporated by reference.

It appears to be widely accepted that a major, if not the major, work related complaint among nurses and hospital nursing staff is back injuries caused by lifting patients and getting them in and out of a bed and to or from a gurney, or a stretcher, as it is commonly called. A survey of existing practices and techniques suggests that there is no widely adopted simple and safe method of transferring patients from a bed to a gurney or visa versa, without lifting them. There are hoist-type lifts where the patient is suspended in a sling. However, the sling must be first manipulated under the patient and the patient must be physically lifted, changing the shape of the body and applying pressures different from those existing on the patient when lying prone in bed. There are also roller boards which are inserted partially under the patient and then the patient is pulled onto the roller board. Again, the patient must be manipulated to allow the board to be inserted and then the body is pulled onto the board. In the end, the patient ends up on the board, not on the gurney or the bed. An additional disadvantage of the roller board is that either the patient must cooperate with the transferor or more than one transferor is required to affect the transfer. Patients have also been known to drop off the roller boards and to land on the floor between the bed and the gurney. U.S. Pat. No. 5,819,339 titled "Patient Transport System", which is hereby incorporated by reference, solves this age-old problem of transferring patients from a bed or a gurney and visa versa. In particular, this patent is directed to an apparatus for transporting a patient and includes a base, a patient supporting member attached to the base, a conveyor attached to the base and a removable sheet. In operation, an end of the sheet which is attached to the conveyor is displaced by rotation of a roller, thereby moving the patient from the bed to the gurney or visa versa. However, in accordance with this patent, the roller must remain affixed to the bed or gurney or the complete conveyor must be removed from the bed or the gurney when not in use. This results in a problem of storing the conveyor in a hospital room and transporting the conveyor when it is not attached to the bed or gurney.

Referring to FIGS. 1-6, which are prior art, a bed 10 includes a bed frame 12 having a headboard 14, a baseboard 16, legs 18 attached to the headboard 14, and to the baseboard 16, and a mattress supporting frame 20 attached to the headboard 14, the baseboard 16, and the legs 18. A mattress 22 (FIG. 2) is supported by the mattress supporting frame 20 (FIG. 1). A gurney or stretcher 30, which is positioned directly adjacent to a side 31 of the mattress 20 of the bed 10 includes a frame 32 having wheels 34 attached thereto. It should be noted that the term gurney and stretcher are used interchangeably herein. A patient supporting member 36 is supported by the frame 32. Both the mattress 20 and the patient supporting member 36 extend in a first longitudinal direction shown by the arrow X.

As can be seen in FIG. 1, both the bed 10 and the gurney 30 have a conveyor 40 attached thereto. Each conveyor 40 includes a roller 42 having two ends or end portions 43*a*, 43*b*. Each end portion 43*a*, 43*b* is rotatably received by or rotatably coupled to a respective bearing member 44. Thus, the bearing members 44 are positioned near opposite ends of the roller 42. A handle 46 may be used to rotate either of the rollers 42. Each bearing member 44 includes a low-friction bearing member and a bearing housing 48. Roller 42, bearing member 44, handle 46 and a coupling 47 used with the handle 46, are similar to those described in U.S. Pat. No. 5,340,266, which is hereby incorporated by reference. Each housing 48 includes an attaching member plate 49 attached to the gurney 30 or bed 10, either by welding a plate 49 to the gurney frame 32 or the bed frame 12 or by fastening a plate 49 to the gurney frame 32 or to the bed frame 12, through fasteners such as screws. For purposes of this discussion, the bed frame 12 and the gurney frame 32 are each considered to be a base for a patient support system.

A sheet, such as bed sheet 80, is releasably attached to a roller 42. An end 81*a* of the bed sheet 80 is releasably attached to the roller 42. The opposite end 81*b* of the sheet 80 is unsecured and is a free end. A conveyor 40 is adapted to move the sheet 80, and in turn, a patient positioned on the sheet 80, in a second longitudinal direction shown by arrow Y, which is transverse to the first longitudinal direction shown by arrow X. By positioning a patient upon the sheet 80, then by rotation of one roller 40, the sheet is moved laterally across the gurney 30 and the bed 10 to move a patient either from the gurney 30 to the bed 10 or from the bed 10 to the gurney 30.

FIGS. 3-6 illustrate another prior art embodiment, whereby the bearing member 144 is removably attached to the headboard 114. The bearing member 144 could just as well be attached to the baseboard (not shown). Directing attention to FIG. 6, the bearing member 144 includes a first leg 146 and a second L-shaped leg 148 integrally attached thereto, which defines an upwardly facing, open ended slot 150 for receiving the end portions of a roller 142. A tab 152 protrudes or extends from the leg 146 dividing the leg 146 into two sections. A locking recess 154 is defined by a C-shaped surface 156 defined in the leg 148 and a portion of an inner surface 158 of leg 148. A lower end of the tab 152 defines an upper portion of the C-shaped surface 156. The bearing member 144 is made of a polymer material, such as high-density polyethylene or ultra high molecular weight polyethylene. Each bearing member 144 is secured to the bed by fasteners which pass through holes 170 defined in the leg 146 or in any other manner.

Directing attention to FIGS. 3-5, the bearing member 144 is removably secured to a bed frame 214 through tubes 200 attached to the frame. The tubes 200 may already be provided adjacent to the four corners of the bed frame 214 and may, in the alternate, be used as intravenous (IV) tube holders which can be used to support posts that hold bags supplying IV drugs to a patient.

However, as illustrated in FIGS. 4 and 5, the bearing holder 202 has an elongated post 204 adapted to be received by the tube 200. The post 204 may include a rectangular upper portion 204*a* and a lower cylindrical portion 204*b* positioned in the tube 200. A plastic spacer block 208 is secured to the upper portion 204*a* of the post 204. The bearing member 144 is then secured to the post 204 and spacer block 208 by bolts 210. The elongated post 204 may have, at one end, a slot 205 used to engage a pin 206 within the tube 200.

However, the structure for supporting the roller 40 may be obtrusive if left upon the bed and, as a result, a design is needed whereby the conveyor 40 may be less obtrusive when it is not in use.

SUMMARY OF THE INVENTION

In one embodiment of the subject invention, a device for use with a base of a patient support system has a patient supporting member attached to the base and a sheet having a first end and a second end. The device is comprised of a roller with a first end and a second end and two bearing holders. Each bearing holder has a bearing member adapted to be secured to a respective one of the first end and the second end of the roller. Each bearing holder may be pivoted relative to the base between an engaged position where the bearing holder extends from the base to position the bearing member to receive a roller end and a stowed position where the bearing holder is recessed within the base when not in use.

In another embodiment of the subject invention, an apparatus for transporting a patient has a base, a patient supporting member attached to the base, and a conveyor removably secured to the base. The conveyor has a roller with a first end and a second end, wherein the roller is removably secured to a bearing member that is secured to the base. The sheet has a first end and a second end. The first end is attached to the conveyor. The sheet is adapted to be positioned onto the patient supporting member. The conveyor also has two bearing holders, each supporting a bearing member, wherein each bearing member is adapted to be secured to a respective one of the first end and the second end of the roller. Each bearing holder may be pivoted relative to the base between an engaged position where the bearing holder extends from the base to position the bearing member to receive a roller end, and a stowed position where the bearing holder is recessed within the base when not in use.

Yet another embodiment of the subject invention is directed to a device for use with a base of a patient support system having a patient supporting member attached to the base and a sheet having a first end and a second end. The device is adapted to support a roller having a first end and a second end and is comprised of two bearing holders. Each bearing holder has a bearing member adapted to be secured to a respective one of the first end and the second end of the roller and has a bearing post which mates with a mounting post. The mounting post is secured to a base post of the base and each bearing holder may be pivoted relative to the post between an engage position where the bearing of the bearing holder extends from the base to position the bearing member to receive a roller end and a stowed position where the bearing holder is recessed within the base when not in use.

Still another embodiment of the subject invention is directed to a method for a device used with a base of a patient support system having a patient supporting member attached to the base and a sheet having a first end and a second end, wherein the sheet first end is adapted to be attached to a roller with a first end and a second end From an engaged position where the bearing of the bearing bolder is secured within the bearing member to receive a roller end to a stowed position where the bearing holder is recessed within the base when no in use, the method involves the steps of lifting the bearing holder from the base post to expose a hinge assembly, rotating the bearing post 180 degrees about the mounting post longitudinal axis, and pivoting the mounting post about the base post in a direction perpendicular to the mounting post to position the mounting post in a stowed position.

DETAILED DESCRIPTION OF THE INVENTION

In each of the arrangements heretofore described, the bearing holder protrudes from the bed when the patient transport system is in operation and, at other times, the bearing holder must be removed and stored in another location. The inventor has found the bearing holder may be retained with the bed or gurney so that not only is it unnecessary to remove the bearing holder when not in use, but furthermore, the bearing holder may be permanently attached to the bed but used only when needed.

Figure 7:
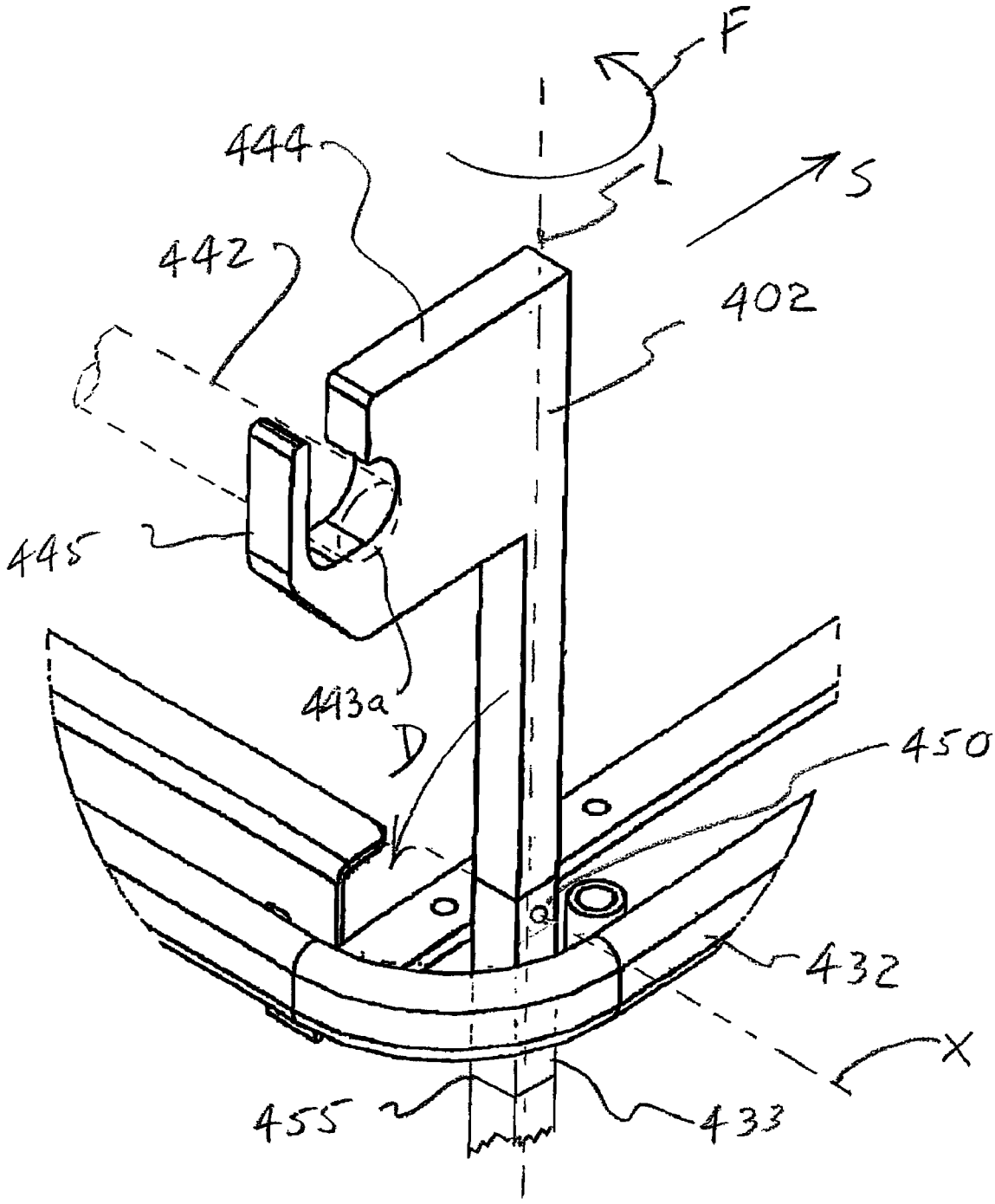
FIG. 7 is a top perspective view of a portion of a bed frame and patient transport bearing unit in a first position or a engaged position made in accordance with the present invention.
Figure 8:
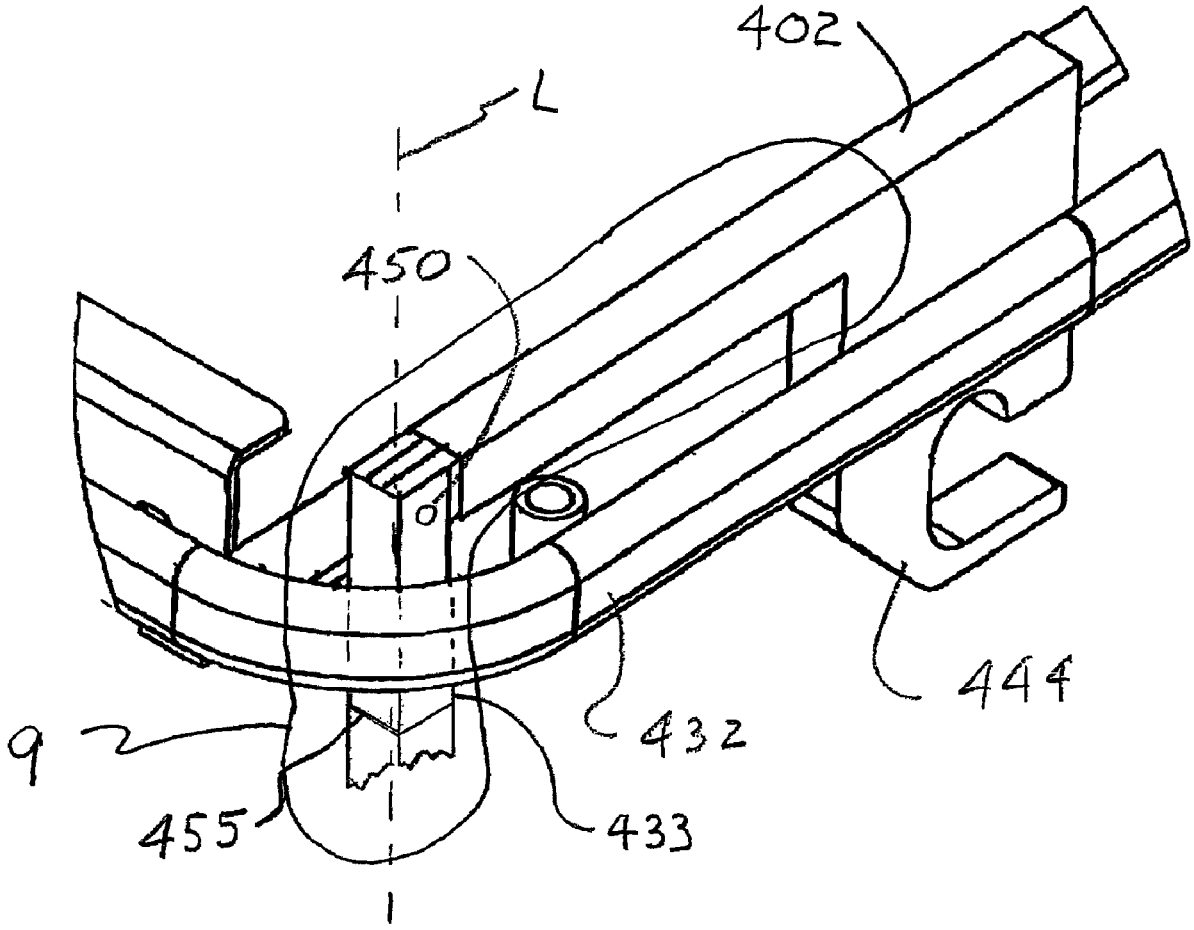
FIG. 8 is a top perspective view of the arrangement shown in FIG. 7 with the patient transport bearing unit in a second position or stowed position.

In particular, in FIG. 7 the bearing holder 402 is in an engaged position and in FIG. 8 the bearing holder 402 is in a stowed position relative to the bed 214.

FIGS. 7 and 8 illustrate a bearing holder 402 similar to bearing holder 202 previously described, however, supported with respect to the base in a different fashion such that bearing holder 402, as illustrated in FIG. 7, is in an extended position. In the extended position, the bearing holder 402 extends from the frame 432 to receive the end 443*a* of roller 442, having a first end 443*a* and a second end (not shown). Although only a single bearing holder 402 is illustrated in FIGS. 7 and 8, it should be appreciated that a single roller requires two bearing holders 402, wherein each bearing holder 402 is adapted to be secured to a respective one of the first end 443*a* and the second end of the roller 442. The bearing holder 402 may be pivoted relative to the base 432 between an engaged position, as illustrated in FIG. 7 and a stowed position, as illustrated in FIG. 8.

In the engaged position illustrated in FIG. 7, the bearing holder 402 is positioned to receive a roller 442 within the bearing member 444 while in the stowed position illustrated in FIG. 8, the bearing holder 402 is recessed within the base 432. In this position, the bearing member 444 is unable to receive and jointly support a roller 42. In the stowed position, the bearing holder 402 provides a low profile relative to the base 432.

The bearing holder 402 is secured to a base support post 433 which is secured to the base 432. The base 432 extends below the segment illustrated in FIG. 7 and it is this lower segment to which the base support 433 may be secured.

Figure 1:
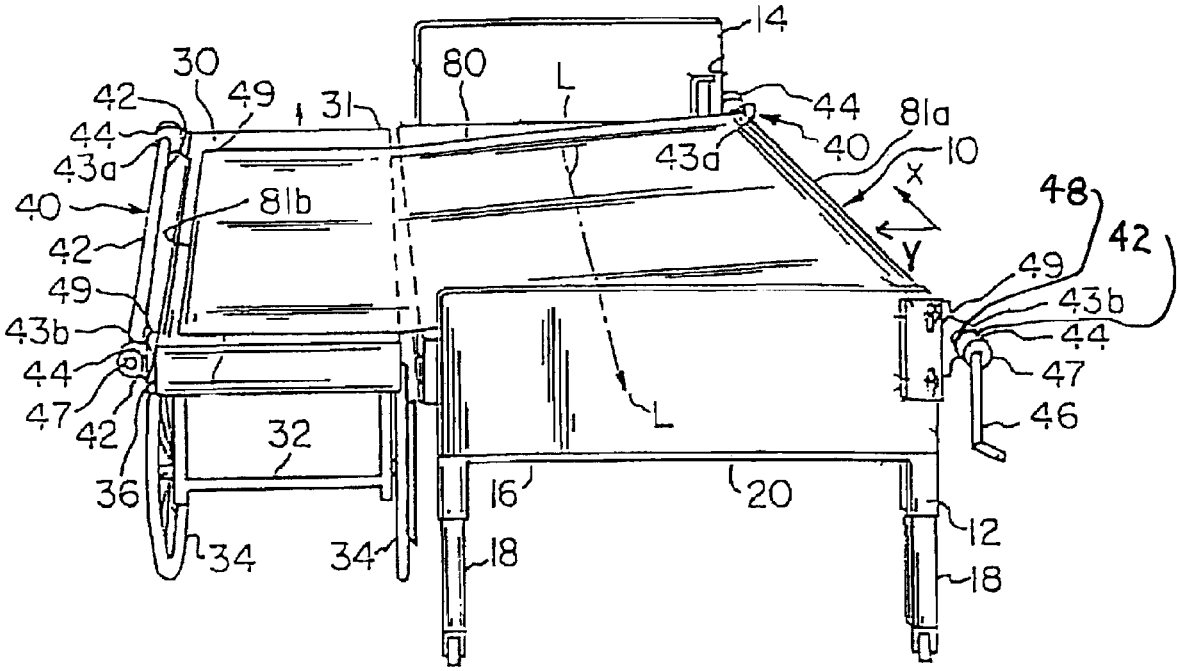
FIG. 1 (PRIOR ART)
FIG. 1 is prior art and is a perspective view of a gurney, a hospital bed and a conveyor.
Figure 2:
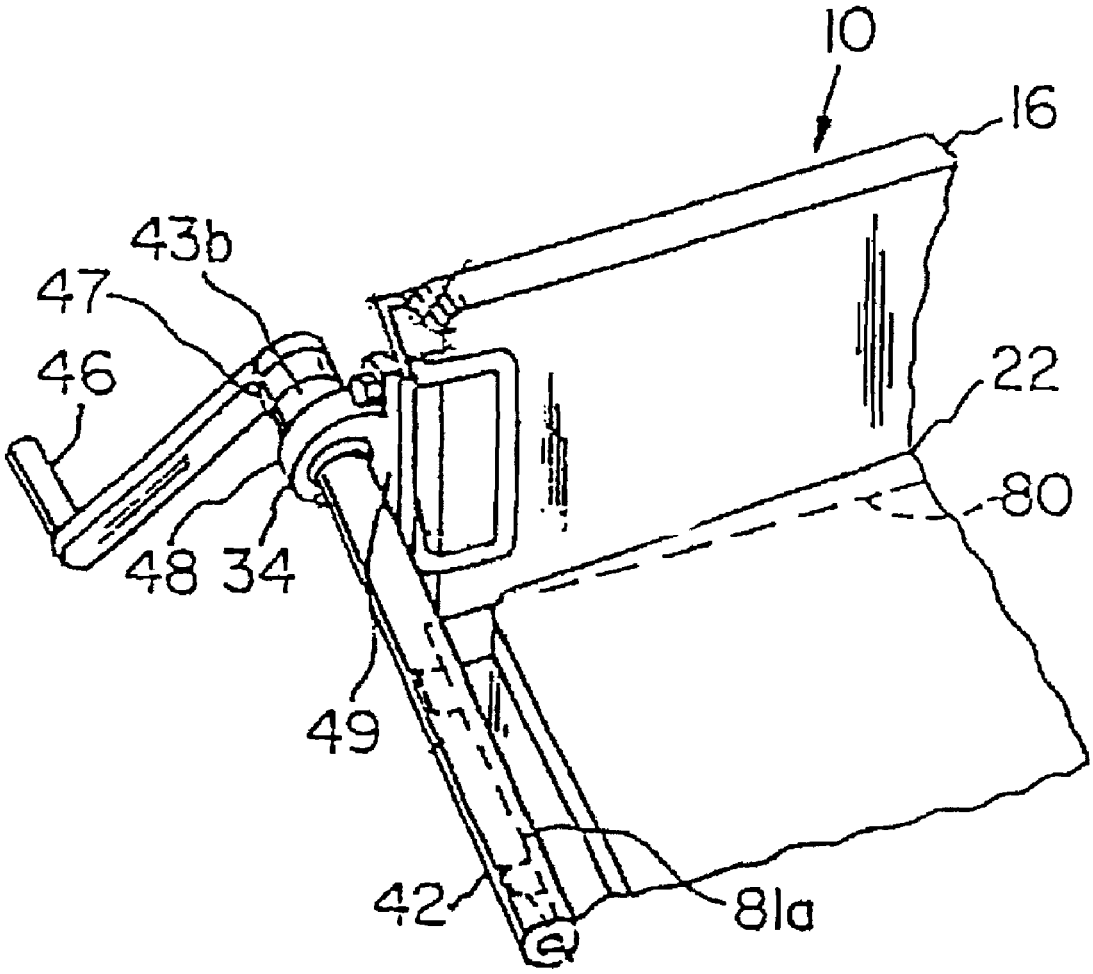
FIG. 2 (PRIOR ART)
FIG. 2 is prior art and is a partial top view of a portion of the bed and the conveyor shown in FIG. 1.
Figure 3:
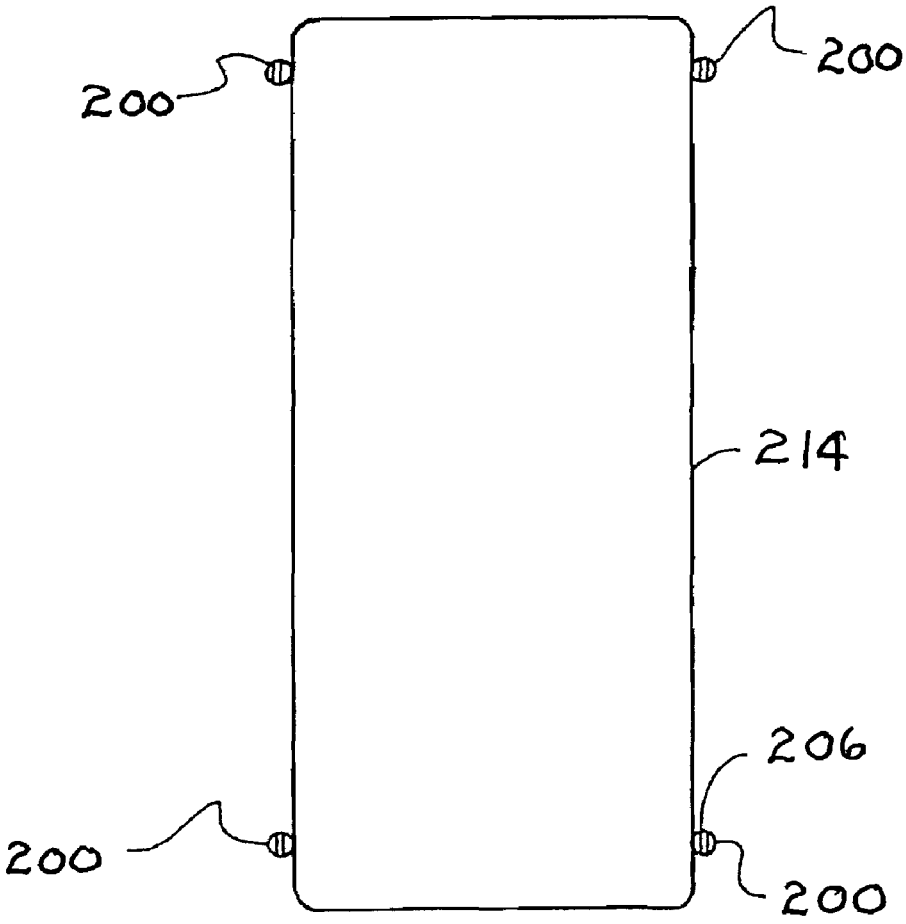
FIG. 3 (PRIOR ART)
FIG. 3 is prior art and is a top view of a bed having bearing holder tubes positioned adjacent to corners of the bed.
Figure 4:
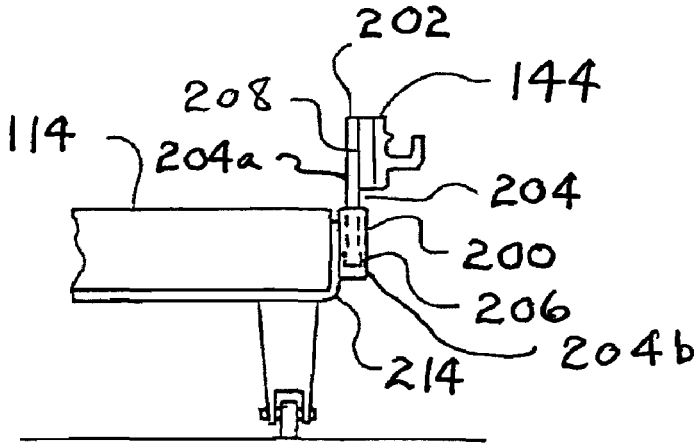
FIG. 4 (PRIOR ART)
FIG. 4 is prior art and is a side view showing a portion of the bed shown in FIG. 3 with a bearing holder and a post.
Figure 5:
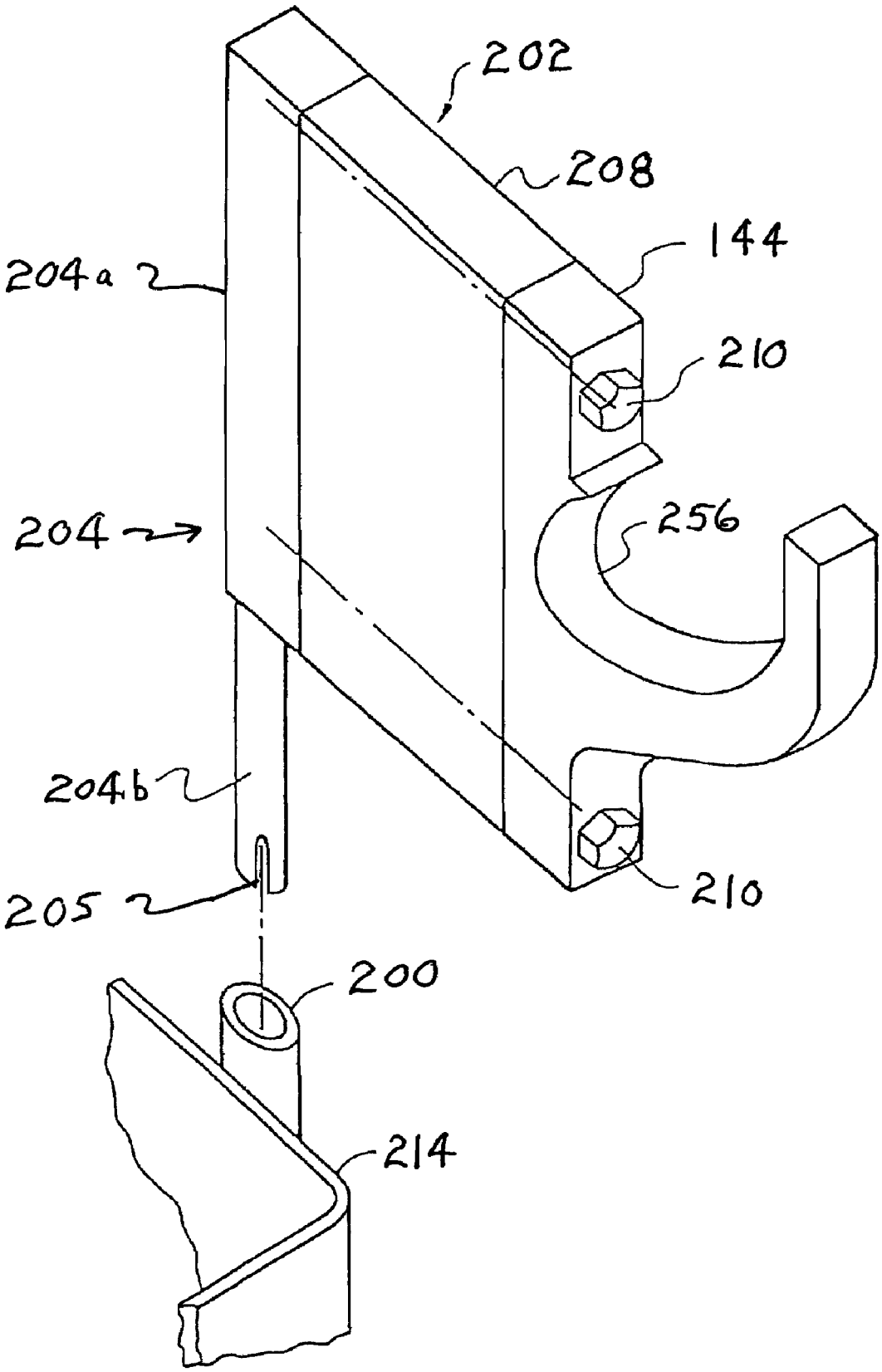
FIG. 5 (PRIOR ART)
FIG. 5 is prior art and is a top perspective fragmentary view showing the bearing holder and the post shown in FIG. 4.

The bearing holder 402 is pivotally mounted to the base 433 through a connecting pin 450 extending through the bearing holder 402 and the base 433. In particular, the bearing holder 402 is pivotal in a direction D perpendicular to the longitudinal axis L extending through the frame support post 433. Additionally, in the engaged position the bearing holder 402 is pivotally locked from rotating about the connecting pin 450 in a direction opposite to that of direction D. In operation, the sheet 80*a* (FIG. 1) attached to the roller 442 will always exert a force in the direction S, as illustrated in FIG. 7. Therefore, with the bearing holder 402 oriented as shown in FIG. 7, when the roller 442 is engaged by a sheet, the bearing holder 402 will not pivot about the connecting pin 450 because its rotation in that direction is locked.

On the other hand, the bearing holder 402 is pivotally free to move in the direction opposite to that direction S. In particular, the bearing holder 402 pivots about an axis X perpendicular to the longitudinal axis L to travel between the engaged position and the stowed position. However, to do so, the bearing holder 402 must be reoriented about the base support post 433 so that pivoting the bearing holder 402 in the direction D will place the bearing holder 402 in the stowed position. To achieve this, the bearing holder 402 may rotate about the longitudinal axis L through a rotary coupling 455 on the frame support post 433. The details of such a rotary coupling 455 are known to those skilled in the art and, for that reason, will not be discussed in detail. Nevertheless, the rotary coupling 455 permits the bearing holder 402 to rotate in the direction of rotation F so that when the bearing holder 402 is pivoted about the connecting pin 450, at least the front portion 445 of the bearing member 444 will be recessed within the frame 432.

Figure 6:
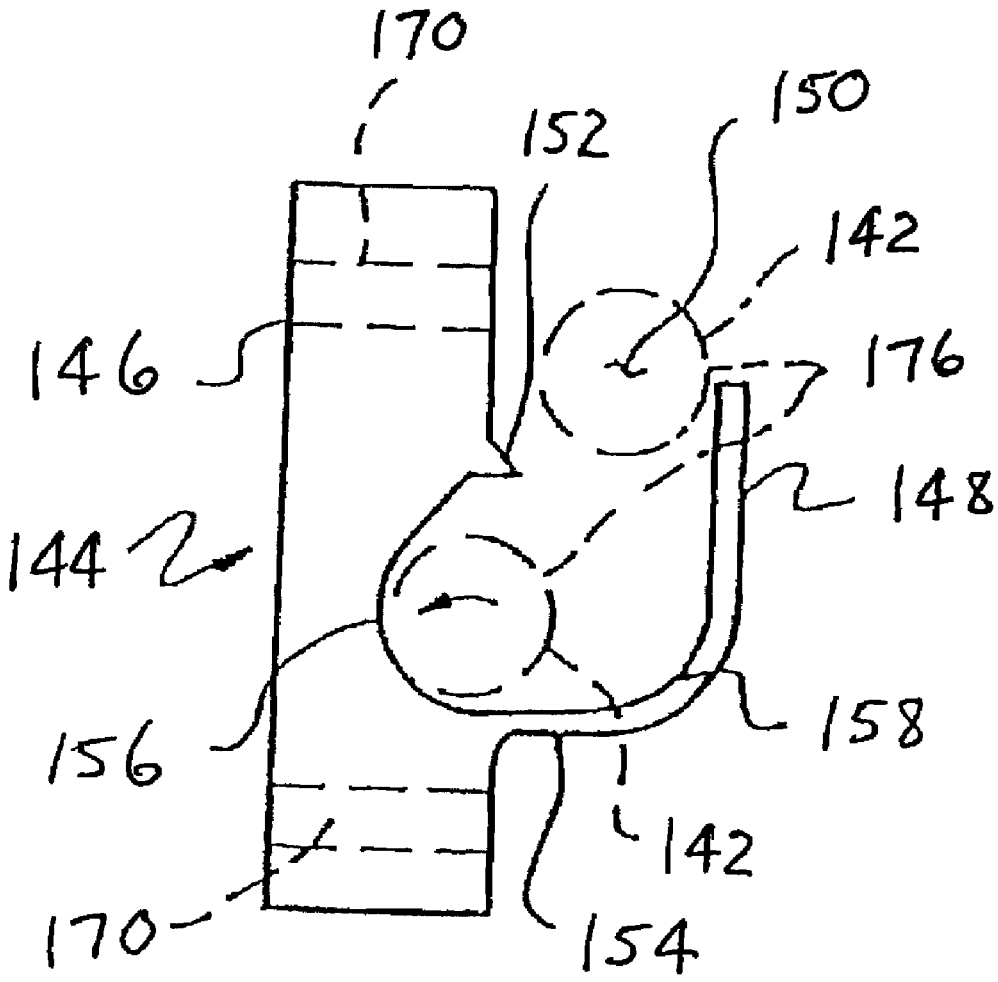
FIG. 6 (PRIOR ART)
FIG. 6 is a side view of the bearing member shown in FIG. 5.

Therefore, it should be appreciated that in the embodiment illustrated in FIGS. 7 and 8, two separate pivots are required. In particular, rotation about the longitudinal axis L in a direction of rotation F, which may be provided by the rotary coupling 455, moves the front end 445 of the bearing member 444 180 degrees and, a second rotation about the connecting pin 450 in the direction D about an axis X perpendicular to the longitudinal axis L folds the bearing member 444 downward relative to the base 433. It should be appreciated that details of the bearing member 444 for holding the roller 442 may be similar to those details discussed with respect to the bearing member 144 in FIG. 6 of the prior art. The bearing holder 402 discussed herein may be applied to a base 432 which may be a gurney, a bed frame, or a wheelchair. Additionally, the bearing holder 402 may be comprised of a polymer material.

Figure 9:
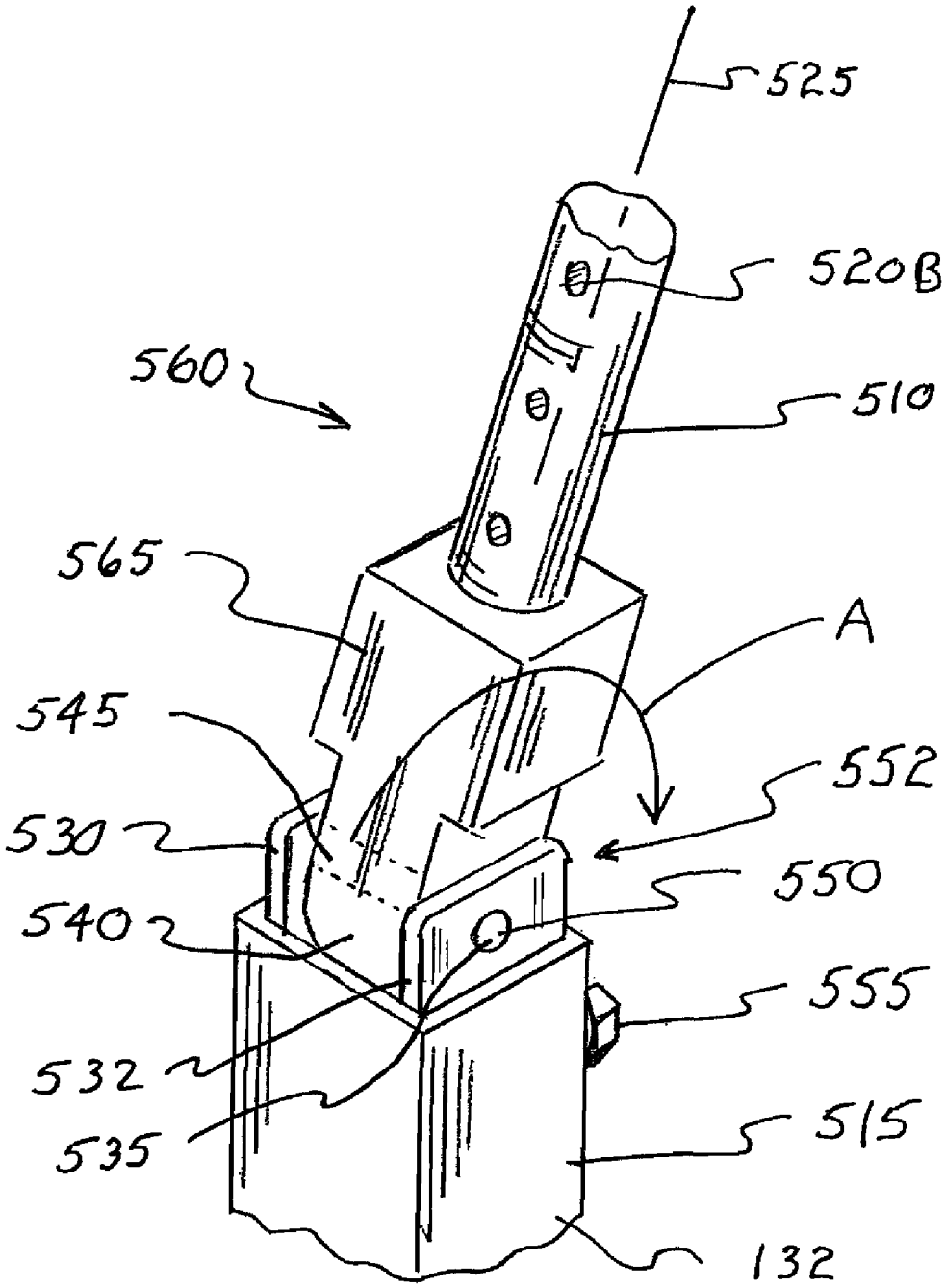
FIG. 9 is an alternate embodiment of the region in FIG. 8 circled and identified with reference number 9, but without the bearing post.
Figure 10:
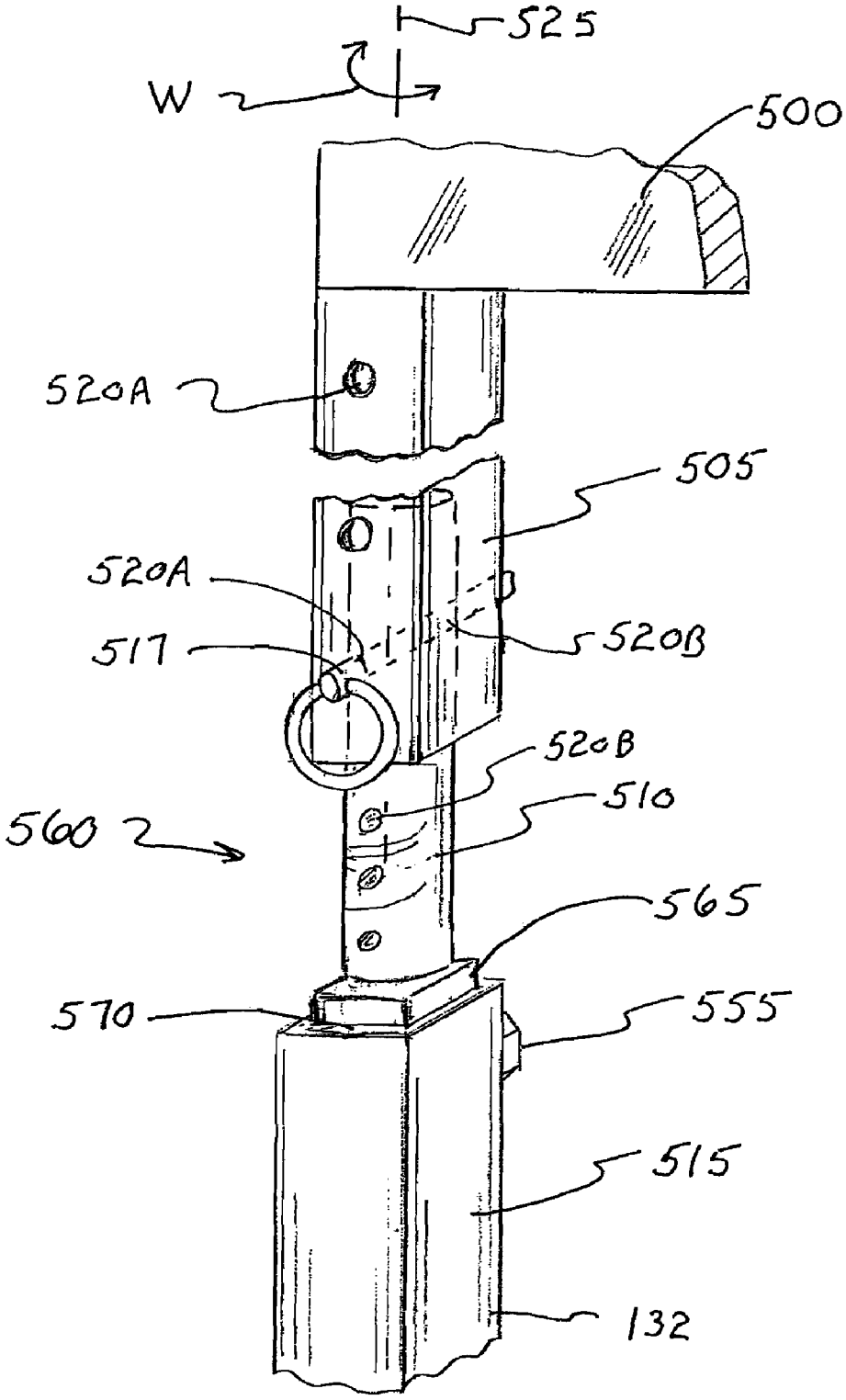
FIG. 10 is an assembled view of the arrangement illustrated in FIG. 9 in the engaged position with the bearing post.

FIGS. 9 and 10 illustrate an alternate embodiment of the subject invention, whereby each bearing holder 500 has a bearing post 505 which mates with a mounting post 510 and, wherein the mounting post 510 is secured to a base post 515 which is part of the base 132 which may be the bed frame 12 or the gurney frame 32. The bearing post 500 and the mounting post 510 are telescopically movable relative to one another to a plurality of positions. In particular, a connecting pin 517 extends through matching bore pairs 520A, 520B between the bearing post 505 and the mounting post 510 to secure the bearing post 505 and mounting post 510 in each of the plurality of positions.

In the embodiment illustrated in FIGS. 9 and 10, the bearing post 505 fits over the mounting post 510. The mounting post 510 has a longitudinal axis 525 and the bearing post 505 rotates about the mounting post longitudinal axis 525 as indicated by arrow W to orient the bearing holder 500 to an engaged position or for a stowed position. The rotational position of the bearing post 505 may be secured with the same connecting pin 515 previously discussed, which extends through the bore pairs 520A, 520B.

FIG. 9 illustrates the mounting post 510 pivoting in the direction indicated by arrow A about the pivot pin 550 toward the stowed position. As such, the mounting post 510 is pivotal about the base post 515 in a direction perpendicular to the mounting post longitudinal axis 525.

The mounting post 510 is secured to the base post 515 with at least one mounting leg 530 (FIG. 9) extending from the base post 515, although an additional mounting leg 532 is also illustrated. The mounting legs 530, 532 have a common bore 535 which extends beyond the base post 515. At least one extension leg 540 has a bore 545 aligned with the bores 530, 532 and extends from the mounting post 510, wherein the mounting legs 530, 532 and the extension leg 540 are pivotally attached to one another with the pivot pin 550 extending through the bores 535, 545 to define a hinge assembly 552.

It should be appreciated that the mounting legs 530, 532 are secured within the base post 515 by a fastener 555 and, as such, the entire bearing holder assembly 560 comprised of the mounting post 510, the extension leg 540, the two mounting legs 530, 532 and the pivot pin 550 is removably attached to the base post 515. It should be noted that the bearing holder assembly 560 may also include a block 565 positioned between the mounting post 510 and the extension leg 540. The block 565, as illustrated in FIG. 10, is mateable with the interior 570 of the base post 515. In the engaged position, the mounting post 510 may be secured directly within the base post 515 through the block 565 which fits securely within the interior 570 of the base post 515 and is engaged by the fastener 555. As such, the fastener 555 may serve the dual purpose of securing the mounting legs 530, 532 within the base post 515 (FIG. 9) for transitioning to the stowed position and, when the block 565 is positioned within the base post 515, securing the block 565 within the base post 515 in the engaged position (FIG. 10). When the block 565 is positioned within the base post 515 and secured therein through fastener 555, the mounting post assembly 560 is held within the base post 515 for maximum lateral support.

Directing attention again to FIGS. 9 and 10, the bearing holder 500 rotates and pivots in a motion similar to that previously described for earlier embodiments. However, in order to transition the bearing holder 500 from the engaged position illustrated, for example, in FIG. 10 to the stowed position, the connecting pin 517 would be removed and the bearing post 505 would be rotated 180 degrees about the mounting post longitudinal axis 525 in the direction of arrow W. The fastener 555 would then be released such that the mounting post assembly 560 could be lifted from the base post 515 until the hinge assembly 552 was exposed (FIG. 9). At that point, the mounting post 510 would be pivoted about the base post 515 in a direction perpendicular to the mounting post longitudinal axis 525 as shown by arrow A to position the mounting post 510 in a stowed position.

The mounting post assembly 560 is completely removable from the base post 515 and, as such, it is possible to retrofit existing beds or gurneys that may have a base post similar to a base post 515 with a mounting post assembly 560 that would be receptive to receiving a bearing holder 500 in accordance with the subject invention.

By providing a device in accordance with the subject invention, it is now possible to retain the bearing member with the base but to pivot the bearing member in an inconspicuous location on the base so that not only is it now unnecessary to remove the bearing member from the base, but furthermore, the bearing member may be stowed on the base itself in an inconspicuous location that will not interfere with the regular operation of the base.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A device for use with a base of a patient support system having a patient supporting member attached to the base and a sheet having a first end and a second end, the device comprising:

a) a roller having a first end and a second end; and b) two bearing holders;

1) wherein each bearing holder has a bearing member adapted to be secured to a respective one of the first end and the second end of the roller; and 2) wherein each bearing holder may be pivoted relative to the base between:

A) an engaged position where the bearing of the bearing holder extends from the base to position the bearing member to receive a roller end; and B) a stowed position where the bearing holder is recessed within the base when not in use.

2. The device according to claim 1, wherein each bearing holder is pivotally mounted to the base so that the bearing holder may pivot between the engaged position and the stowed position.

3. The device according to claim 2, wherein each bearing holder is pivotally mounted through a connecting pin extending through the bearing holder and the base.

4. The device according to claim 3, wherein in the engaged position the bearing holder is pivotally locked in the direction the rollers will urge the bearing holder when in use.

5. The device according to claim 3, wherein in the engaged position the bearing holder is pivotally free to move in the direction opposite to that direction the rollers will urge the bearing holder when in use.

6. The device according to claim 2, wherein the bearing holder has a longitudinal axis and pivots about an axis perpendicular to the longitudinal axis to travel between the engaged position and the stowed position.

7. The device according to claim 2, wherein each bearing holder is rotatable about its longitudinal axis.

8. The device according to claim 7, wherein from the engaged position to the stowed position, the bearing holder is rotated about the longitudinal axis and is then pivoted to the stowed position.

9. An apparatus for transporting a patient comprising:

a) a base;

b) a patient supporting member attached to the base;

c) a conveyor removably secured to the base, wherein the conveyor comprises a roller having a first end and a second end, wherein the roller is removably secured to a bearing member that is secured to the base;

d) a sheet having a first end and a second end, the first end attached to the roller of the conveyor, wherein the sheet is adapted to be positioned onto the patient supporting member;

e) two bearing holders each supporting a bearing member;

f) wherein each bearing member is adapted to be secured to a respective one of the first end and the second end of the roller; and g) wherein each bearing holder may be pivoted relative to the base between:

1) an engaged position where the bearing holder extends from the base to position the bearing member to receive a roller end; and 2) a stowed position where the bearing holder is recessed within the base when not in use.

10. An apparatus for transporting a patient as claimed in claim 9, wherein the apparatus is one selected from the group of a gurney, bed frame and wheelchair.

11. An apparatus for transporting a patient as claimed in claim 9, wherein the bearing member comprises a polymer material.

12. A device for use with a base of a patient support system having a patient supporting member attached to the base and a sheet having a first end and a second end, wherein the sheet first end is adapted to be attached to a roller with a first end and a second end, the device comprising two bearing holders wherein;

a) each bearing holder has a bearing member adapted to be secured to a respective one of the first end and the second end of the roller; and b) each bearing holder may be pivoted relative to the base between:

1) an engaged position where the bearing of the bearing holder extends from the base to position the bearing member to receive a roller end; and 2) a stowed position where the bearing holder is recessed within the base when not in use.

13. A device for use with a base of a patient support system having a patient supporting member attached to the base and a sheet having a first end and a second end, wherein the device is adapted to support a roller having a first end and a second end, the device comprising two bearing holders wherein:

a) each bearing holder has a bearing member adapted to be secured to a respective one of the first end and the second end of the roller and has a bearing post which mates with a mounting post, wherein the mounting post is secured to a base post of the base; and b) each bearing holder may be pivoted relative to the base post between:

1) an engaged position where the bearing of the bearing holder extends from the base to position the bearing member to receive a roller end; and 2) a stowed position where the bearing holder is recessed within the base when not in use.

14. The device according to claim 13, wherein the bearing post and the mounting post are telescopically movable relative to one another to a plurality of positions.

15. The device according to claim 14, wherein a connecting pin extends through matching bore pairs between the bearing post and mounting post to secure the bearing post and mounting post in each of the plurality of positions.

16. The device according to claim 13, wherein the bearing post fits over the mounting post.

17. The device according to claim 16, wherein the mounting post has a longitudinal axis and the bearing post rotates about the mounting post longitudinal axis.

18. The device according to claim 17, wherein the rotational position of the bearing post may be secured with a connecting pin extending through matching bore pairs between the bearing post and the mounting post.

19. The device according to claim 13, wherein in the stowed position, the mounting post is pivoted about the base post in a direction perpendicular to the mounting post longitudinal axis.

20. The device according to claim 19, wherein at least one mounting leg with a bore extends from the base post and at least one extension leg with matching aligned bore extends from the mounting post, and wherein the at least one mounting leg and the at least one extension leg are pivotally attached to one another with a pivot pin extending through the bores.

21. The device according to claim 13, wherein in the engaged position, the mounting post assembly comprised of the mounting post, a block attached thereto, the at least one extension leg and the at least one mounting leg is removably attached to the base post.

22. The device according to claim 21, wherein the mounting post assembly is removably attached to the base post through a removable fastener.

23. The device according to claim 21, wherein the block of the mounting post assembly is retracted within the base post for maximum lateral support.

24. For a device used with a base of a patient support system having a patient supporting member attached to the base and a sheet having a first end and a second end, wherein the sheet first end is adapted to be attached to a roller with a first end and a second end, for positioning a bearing holder from an engaged position where it is secured within the bearing member to receive a roller end, to a stowed position where the bearing holder is recessed within the base when not in use; a method comprising the steps, from the engaged position, of:

a) lifting the bearing holder from the base post to expose a hinge assembly;

b) rotate the bearing post 180 degrees about the mounting post longitudinal axis;

c) pivot the mounting post about the base post in a direction perpendicular to the mounting post to position the mounting post in a stowed position.

* * * * *

UNITED STATES PATENT AND TRADEMARK OFFICE

CERTIFICATE OF CORRECTION

PATENT NO. : 7,480,949 B2
APPLICATION NO. : 11/465994
DATED : January 27, 2009
INVENTOR(S) : Bloomquist, Jr.

It is certified that error appears in the above-identified patent and that said Letters Patent is hereby corrected as shown below:

Title Page, See Item (75) Inventor: "E. Glynn Bloomquist" should read
-- E. Glynn Bloomquist, Jr. --

Signed and Sealed this

Nineteenth Day of May, 2009

John Doll

JOHN DOLL
*Acting Director of the United States Patent and Trademark Office*